United States Patent [19]

Leroy et al.

[11] Patent Number: 4,533,452

[45] Date of Patent: Aug. 6, 1985

[54] ELECTROLYSIS TANK, FOR THE PRODUCTION OF ALUMINUM, HAVING A FLOATING CONDUCTIVE SCREEN

[75] Inventors: Michel Leroy; Maurice Keinborg, both of Saint Jean de Maurienne, France

[73] Assignee: Aluminium Pechiney, Paris, France

[21] Appl. No.: 509,585

[22] Filed: Jun. 30, 1983

[30] Foreign Application Priority Data

Jun. 30, 1982 [FR] France ..... 82 11873

[51] Int. Cl.[3] ..... C25C 3/08; C25B 11/03; C25B 11/04

[52] U.S. Cl. ..... 204/243 R; 204/284; 204/290 R; 204/291

[58] Field of Search ..... 204/67, 243 R, 243 M, 204/244, 245, 246, 247, 284, 268, 290 R, 291

[56] References Cited

U.S. PATENT DOCUMENTS

| | | | |
|---|---|---|---|
| 2,407,691 | 9/1946 | Suchy et al. | 204/247 |
| 3,554,893 | 1/1971 | DeVarda | 204/244 |
| 4,177,128 | 12/1979 | Rahn | 204/243 R |
| 4,338,177 | 7/1982 | Withers et al. | 204/243 R |
| 4,436,598 | 3/1984 | Tabereaux et al. | 204/67 |
| 4,443,313 | 4/1984 | Gesing et al. | 204/284 X |
| 4,462,886 | 7/1984 | Kugler | 204/243 R |

*Primary Examiner*—Donald R. Valentine
*Attorney, Agent, or Firm*—Oblon, Fisher, Spivak, McClelland & Maier

[57] ABSTRACT

The invention relates to an electrolysis tank for production of aluminum by electrolysis of alumina dissolved in a molten cryolite bath, by the Hall-Heroult process, between at least a carbon anode and an aluminum sheet covering a carbon cathode substrate. At the interface of the aluminum sheet and molten cryolite bath it comprises a floating screen, which is conductive of electric current, not connected to the carbon cathode substrate and free to move at least in the vertical direction.

The floating conductive screen can extend over the entire interface or be limited to being perpendicular to each anode.

The distance between each anode and the floating conductive screen can be reduced to about 20 mm.

2 Claims, 5 Drawing Figures

ELECTROLYSIS TANK, FOR THE PRODUCTION OF ALUMINUM, HAVING A FLOATING CONDUCTIVE SCREEN

BACKGROUND OF THE INVENTION

1. Field of the Invention

This invention relates to a tank for producing aluminum by electrolysis of alumina dissolved in molten cryolite according to the Hall-Heroult process.

2. Description of the Prior Art

In the best performing installations producing aluminum by the Hall-Heroult process, the consumption of electric energy is at least equal to 13,000 KWh per ton of metal, and often exceeds 14,000. In a modern tank operating under a potential difference of 4 volts, the voltage drop in the electrolyte represents about 1.5 volts; it is therefore responsible for more than a third of the total energy consumption. This is due to the necessity of maintaining a sufficient distance between the anode and the cathode liquid aluminum sheet (at least equal to 40 mm and, most often, on the order of 50 to 60 mm) to prevent the reoxidation of the aluminum entrained to the anode by the movements of the sheet of liquid metal due to the magnetic effects and facilitated by the nonwettability of the carbon cathode substrate by the liquid aluminum.

To reduce the interpolar distance, without causing the entrainment of the cathode aluminum toward the anode, it has been proposed to use cathodes with a base of electroconductive refractories, such as titanium boride $TiB_2$ which is completely wetted by the liquid aluminum and undergoes virtually no attack by this metal at the electrolysis temperature. These cathodes have been described, in particular, in the British Pat. Nos. 784,695, 784,696, 784,697 of BRITISH ALUMINUM CO., and in the article by K. B. BILLEHAUG and H. A. OYE in "ALUMINUM", October 1980, pages 642–648 and November 1980, pages 713 to 718.

One of the major problems that these titanium boride cathodes pose is their gradual going into solution in the liquid aluminum, a slow but not inconsiderable phenomenon which requires the periodic replacement of the elements used and involves total stopping and disassembly of the tank.

SUMMARY OF THE INVENTION

An object of the present invention is to provide another solution to the problem of the reduction of the interpolar distance without risk of entrainment of the cathodic aluminum to the anode.

The present invention is characterized by placing, between the anode and the cathode, at the interface of the liquid aluminum sheet and the layer of electrolyte, a floating screen that conducts electric current, and is not connected to the carbon cathode substrate. Since this screen needs be resistant both to the action of the aluminum and to the action of the molten cryolite bath, it consists of a carbon substance such as graphite, or an electroconductive refractory such as titanium boride.

If the respective densities of the elements in the presence of the average temperature for electrolysis (~960° C.) is considered Graphite: 1.7–1.9
Electrolyte: 2.1–2.2
Aluminum: 2.3
$TiB_2$: 4.5–4.6 it appears that the floating screen should consist of elements whose overall density is between about 2.15 and 2.30 at 960°.

DETAILED DESCRIPTION OF THE PREFERRED EMBODIMENTS

Figure 1:
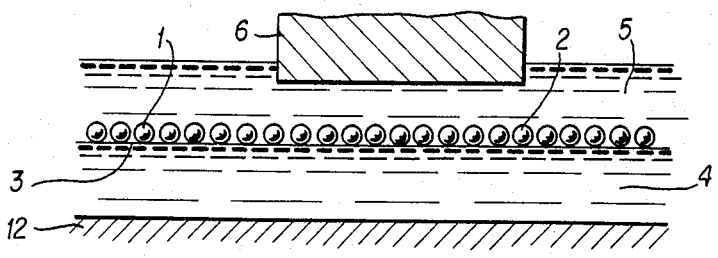
FIGS. 1–4 illustrate different embodiments of the floating conductive screen of the present invention.

In FIG. 1, the floating conductive screen (1) consists of $TiB_2$ balls (2) that are porous but made fluidtight on the surface with an average density of 2.25. These balls can be manufactured, for example, by the technique described in French Pat. No. 1,579,540 in the name of ALUMINIUM PECHINEY, and which consists in sintering a mixture of $TiB_2$ and a substance that can be eliminated at the sintering temperature. The diameter of these balls is between 5 and 50 mm and, preferably, between 10 and 40 mm. The lower diameter limit is connected to manufacturing costs and the upper limit corresponds to about twice the planned interpolar distance.

These balls having a porosity of about 50% can be considered too fragile. In this case, a mixture of $TiB_2$ and boron nitride (d=2.20 to 2.25 at 960°) or graphite (d=1.7 to 1.9), with the desired proportion of substance that can be eliminated with heat to obtain a final density approximately equal to 2.25 at 960° C.

It is essential to make the balls fluidtight by a surface coating to prevent their gradual impregnation by the electrolyte and/or the metal, which would destroy their ability to float. They can be made fluidtight by various known processes that make it possible to make a compact $TiB_2$ deposit, for example, plasma spraying or chemical depositing. The thickness of this fluidtight layer is sufficient for the dissolution by the liquid aluminum to make possible a life of at least several years, i.e., at least equal to 20 micrometers.

They can be made fluidtight in two stages: depositing of a fairly dense anchoring layer with plasma, then a fine fluidtight layer by chemical depositing or again by chemical depositing in a vapor phase performed in two stages, the first being done at a lower pressure and temperature than the second.

Another solution, to obtain the average density of 2.25 consists in making composite balls with a graphite core and a compact $TiB_2$ skin, the proportion by weight of the two constituents being determined to obtain d=2.25 (approximately 20% $TiB_2$ and 80% graphite), the graphite quality being thus chosen so that the coefficient of expansion of the graphite is approximately equal to that of $TiB_2$ between 0° and 1,000° C.

Figure 2:
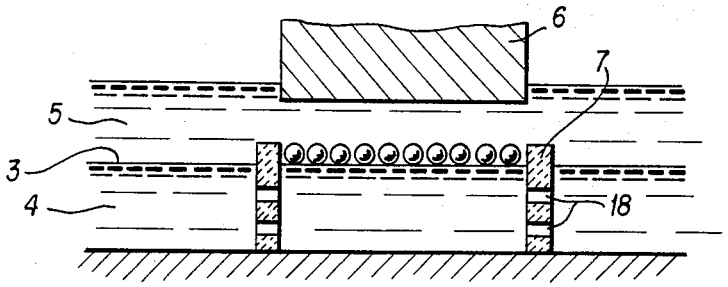

The floating balls (2) of $TiB_2$ form a layer approximately continuous with the interface (3) of the metal (4) and the electrolyte (5). It is this layer which forms the screen (1) between the anode (6) and the metal (4) and, at the same time, acts as cathode on which droplets of liquid aluminum, produced by electrolysis, are formed. These droplets wet the floating balls (2) and are collected in the layer already formed (4). The risk of entrainment of the droplets to the anode, where they would be reoxidized, is therefore practically eliminated, which makes it possible to reduce the interpolar distance d to about 20 millimeters and to lower the voltage drop in the electrolyte to less than 1 volt. In FIGS. 1 and 2, the floating balls (2) have been drawn above the interface (3), but it is quite obvious that their exact position depends on their density ratio to the bath and the metal.

Although the invention has been described in the particular case where the floating screen is formed with balls with a $TiB_2$ base, this form is not mandatory and any other form can be suitable, for example, cylindrical elements which, depending on their length/diameter ratio, will float with the axis in vertical or horizontal position. Flat disks, for example, can be used. In this case, (elements not connected to each other), it is desired that the largest dimension of the elements used not exceed 50 mm and, preferably, 40 mm, i.e., twice the intended interpolar distance.

The solution of FIG. 1 exhibits the drawback that all the interface of the metal (4) and the electrolyte (5) is covered by the screen of balls (2) while its presence is necessary only perpendicular to the anodes (6).

FIG. 2 represents a solution in which the floating conductive screen is limited to being perpendicular to the anodes (6) by barriers (7) of dense refractory material. Openings (18) must, preferably, be made in these barriers to assure circulation of the liquid aluminum (4).

Figure 3:
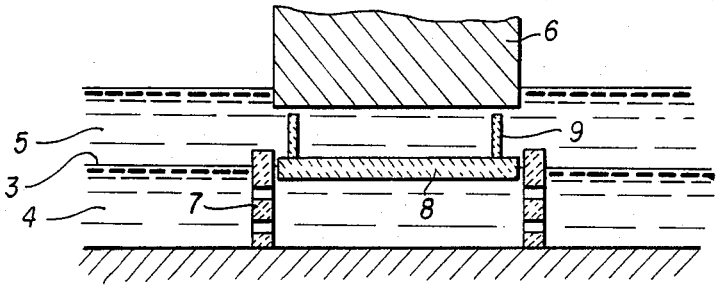

FIG. 3 represents another embodiment of the floating conductive screen; the screen no longer consists of simply juxtaposed individual elements, but of a single-piece unit placed perpendicular to the anode. This single-piece screen (8) can be made in different variants, without going outside the scope of the invention, to the extent that it meets the two basic criteria: density between that of the electrolyte and that of the liquid aluminum, and sufficient electric conductivity, i.e., less than that of the electrolyte (at least 10 times lower, for example).

The screen (8), further, can be kept perpendicular to the anode by barriers (7) and can, optimally, be provided with bosses (9) of refractory material that is resistant to the electrolyte and liquid aluminum, and slightly conductive of electricity such as boron nitride, aluminum nitride, or various carbides such as silicon carbide. These bosses are intended to avoid any accidental contact between the anode (6) and the screen (8). The freedom of movement of the screen in the vertical direction is actually almost total because of the absence of any anchoring means on the carbon cathode substrate (12).

The screen (8) can consist of graphite or carbon felt or carbon/carbon composite material, covered with $TiB_2$ over at least its upper face. If the proportion of $TiB_2$ is not sufficient to obtain the required average density (2.25), the screen can be ballasted with dense refractory inserts, or again consist not of pure graphite, but of an agglomerated mixture of graphite and silicon carbide ($d=3$ to 3.10) or titanium boride ($d=4.5$ to 4.6).

In case the screen is of a porous carbon composite, it is preferably made to undergo thorough impregnating with titanium boride, in such a proportion an apparent average density on the order of 2.20 is attained, then it is made fluidtight on the surface with a compact layer of titanium boride 10 to 100 micrometers thick.

Figure 4A:
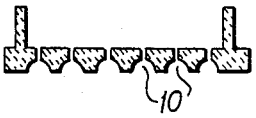
Figure 4B:
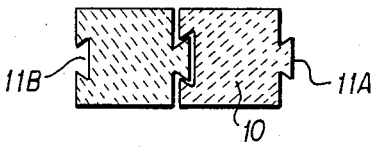

Another embodiment of the floating conductive screen is shown in FIGS. 4*a* and 4*b*. The graphite plates (10) are provided with anchoring means (11A, 11B) which work together to form assemblies provided with sufficient flexibility to adapt to possible unevennesses in the metal-electrolyte interface (3).

As in the preceding case, these plates can be covered with $TiB_2$ on the face opposite the anode, the density necessary for floating is obtained by any of the means described above.

Use of the invention, in its different variants, makes possible a considerable reduction of the interpolar distance, up to about 20 mm, without loss of electrolysis efficiency. The potential difference across the electrolysis cells thus modified is reduced from 4 volts to about 3.2 to 3.3 volts, with proportional reduction of the energy consumption per ton of aluminum produced.

We claim:

1. An electrolysis tank for producing aluminum by electrolysis of alumina dissolved in a bath of molten cryolyte between at least one superior carbonaceous anode and a pool of molten aluminum covering an inferior carbonaceous cathodic substrate, said tank comprising, at the interface of the pool of molten aluminum and the bath of molten cryolyte:

a floating screen conductive to electric current wherein said screen comprises a single layer of regularly shaped conductive elements wherein said screen is limited to the space below said anode and wherein said conductive elements comprise porous $TiB_2$ having an average density between 2.2 and 2.25 and wherein said screen further comprises an external layer of $TiB_2$ having a thickness of at least 20 micrometers in order to make the surface of said screen superficially fluid tight.

2. An electrolysis tank for producing aluminum by electrolysis of alumina dissolved in a bath of molten cryolite between at least one superior carbonaceous anode and a pool of molten aluminum covering an inferior carbonaceous cathodic substrate, said tank comprising, at the interface of the pool of molten aluminum and the bath of molten cryolite:

a floating screen conductive to electric current wherein said screen comprises a single layer of regularly shaped conductive elements wherein said screen is limited to the space below said anode and wherein said screen is further provided with at least a pair of bosses of refractory material which are resistant to said molten cryolite and said pool of molten aluminum and wherein said bosses are provided in order to avoid accidental contact between said anode and said screen.

* * * * *